US005535968A

United States Patent [19]

Mokkapati et al.

[11] Patent Number: 5,535,968

[45] Date of Patent: Jul. 16, 1996

[54] VITAL RAILWAY SIGNAL LINK

[75] Inventors: Chinnarao Mokkapati, Export; Ronald R. Capan, Pittsburgh, both of Pa.

[73] Assignee: Union Switch & Signal Inc., Pittsburgh, Pa.

[21] Appl. No.: 919,863

[22] Filed: Jul. 27, 1992

[51] Int. Cl.[6] ..... B61L 27/00

[52] U.S. Cl. ..... 246/3; 330/306; 359/176

[58] Field of Search ..... 359/114, 173, 359/179, 154, 162, 161, 171, 180, 188, 176; 333/172, 177, 178; 307/106, 107, 108; 246/7.5, 3; 364/550; 340/664; 330/306, 189

[56] References Cited

U.S. PATENT DOCUMENTS

| | | | |
|---|---|---|---|
| 3,737,806 | 6/1973 | Darrow . | |
| 3,793,596 | 2/1974 | Grundy . | |
| 3,800,181 | 3/1974 | Spencer, Jr. | 315/388 |
| 3,950,690 | 4/1976 | Campbell . | |
| 3,975,643 | 8/1976 | Toth . | |
| 4,009,454 | 2/1977 | Darrow . | |
| 4,125,784 | 11/1978 | Harrison . | |
| 4,130,764 | 12/1978 | Darrow . | |
| 4,289,373 | 9/1981 | Sugimuto et al. | 359/114 |
| 4,320,315 | 3/1982 | Kuhn . | |
| 4,320,354 | 3/1982 | Harrison . | |
| 4,399,564 | 8/1983 | Cowen | 359/176 |
| 4,451,804 | 5/1984 | Veize et al. | 333/177 |
| 4,560,953 | 12/1985 | Bozio . | |
| 4,611,291 | 9/1986 | Hoelscher | 364/550 |
| 4,755,692 | 7/1988 | Nagel . | |
| 4,770,522 | 9/1988 | Allen | 350/633 |
| 4,879,761 | 11/1989 | Webb | 359/176 |
| 4,894,629 | 1/1990 | Okamura et al. | 333/177 |
| 5,005,212 | 4/1991 | Wood | 359/114 |
| 5,041,745 | 8/1991 | Raso | 307/520 |
| 5,060,301 | 10/1991 | Nishimura | 359/179 |
| 5,064,274 | 11/1991 | Allen | 359/604 |
| 5,105,295 | 4/1992 | O'Byrne | 359/191 |

*Primary Examiner*—Benedict V. Safourek
*Assistant Examiner*—Ajit Patel
*Attorney, Agent, or Firm*—Buchanan Ingersoll

[57] ABSTRACT

A vital railway signal link for passing DC signals between a first terminal location and a second terminal location. A transmitter at the first terminal location receives a DC input signal and responsively produces a light signal modulated at a preselected frequency. The light signal is conducted through an optical fiber to the second terminal location. There, a receiver detects the light signal and produces a DC output signal. The receiver contains discriminator circuitry preferably including a bandpass filter to prevent light signals other than those modulated at the preselected frequency from giving an output signal.

25 Claims, 3 Drawing Sheets

VITAL RAILWAY SIGNAL LINK

BACKGROUND OF THE INVENTION

1. Field of the Invention

The present invention relates generally to the art of railway signaling. More particularly, the invention relates to a vital apparatus and method for transmitting railway signal information from an electrical link input at a first terminal location to an electrical link output at a second terminal location.

2. Description of the Prior Art

In the control of railroad and rail-borne transit vehicles, control signals are frequently passed over significant distances. These control signals may, for example, actuate switch turnouts to allow traffic flow to branch from one track to another. Additionally, the control signals may actuate wayside indicators to display an appropriate aspect for the prevailing speed conditions.

In order to prevent a system failure from causing a problem, many railway signalling components are designed to have "vital" characteristics. In the art, the term "vital" signifies a component designed to give the most restrictive condition in the event of a failure. It is thus desirable to have signal links for passing signal information between field locations be constructed using vital design principles.

A vital railway signal link practicing the present invention transmits information between an electrical link input at a first terminal location and an electrical link output at a second terminal location. In response to a DC input signal applied to the electrical link input, transmitting means at the first terminal location emit a light signal modulated at a preselected frequency. The light signal is transmitted to receiver means at the second terminal location via an optical conductor such as an optical fiber. A DC output signal is then provided at the electrical link output. To prevent stray ambient light from causing an errant output signal at the electrical link output, discriminator means are provided which assure essentially no output signal if other than a light signal modulated at the preselected frequency appears at the receiver means. Thus, the term "discriminator" is used herein to signify means that are adjusted to accept or reject signals of different characteristics (such as amplitude or frequency).

In presently preferred embodiments, the light signal is produced by application of the DC input signal to a free running oscillator. A periodic electrical signal produced by the oscillator is applied to photo-emission means, such as an infrared light emitting diode driven by a Darlington emitter follower transistor network. At the second terminal location, photo-sensitive input means detect the periodic light signal and produce an analogous electrical signal. The discriminator characteristics are preferably provided by a relatively narrow bandpass filter which may be constructed having a pair of resonant circuits coupled by an electrical isolation coupler. The bandpass filter receives the analogous electrical signal and produces a filtered output signal. Signals of other frequencies are blocked. Output means, which may comprise impedance matching and amplification transistor networks feeding a rectifier network, receive the filtered electrical signal and produce the DC output signal.

Other presently preferred embodiments of the invention are bidirectional, having a receiver and transmitter at both terminal locations. Still other embodiments utilize one or more repeaters to compensate accrued line losses occurring in the conductor. Each repeater may simply comprise a receiver having a DC output tied to the DC input of a transmitter. Using such repeaters, the effective operable length of the railway signal link may be extended to virtually any desired value.

DETAILED DESCRIPTION OF PRESENTLY PREFERRED EMBODIMENTS

In accordance with the invention, a vital link may be provided to transmit railway signal information from an electrical link input at a first terminal location to an electrical link output at a second terminal location. Unlike simple copper conductors used in the prior art, the link utilizes an optical conductor as the transmission medium. Thus, in addition to being vital, the link is relatively immune to external electromagnetic interference. The link is also generally incapable of generating interference to any apparatus operating in its vicinity.

Figure 1:
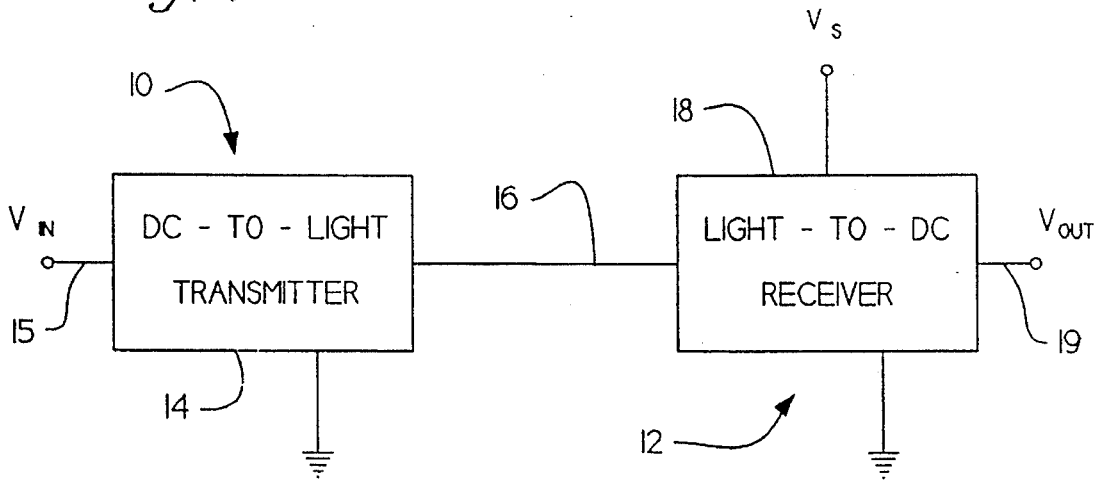
FIG. 1 is a diagrammatic representation of a vital railway signal link constructed in accordance with the invention.

FIG. 1 illustrates a presently preferred railway signal link utilized to transmit signal information from first terminal location 10 to second terminal location 12. specifically, DC-to-light transmitter 14 receives a DC input signal $V_{IN}$ from input 15 and responsively emits a light signal onto optical fiber 16. The light signal is then received by light-to-DC receiver 18. Receiver 18, which is powered by a source voltage $V_S$, gives a DC output signal $V_{OUT}$ on link electrical output 19.

Figure 2:
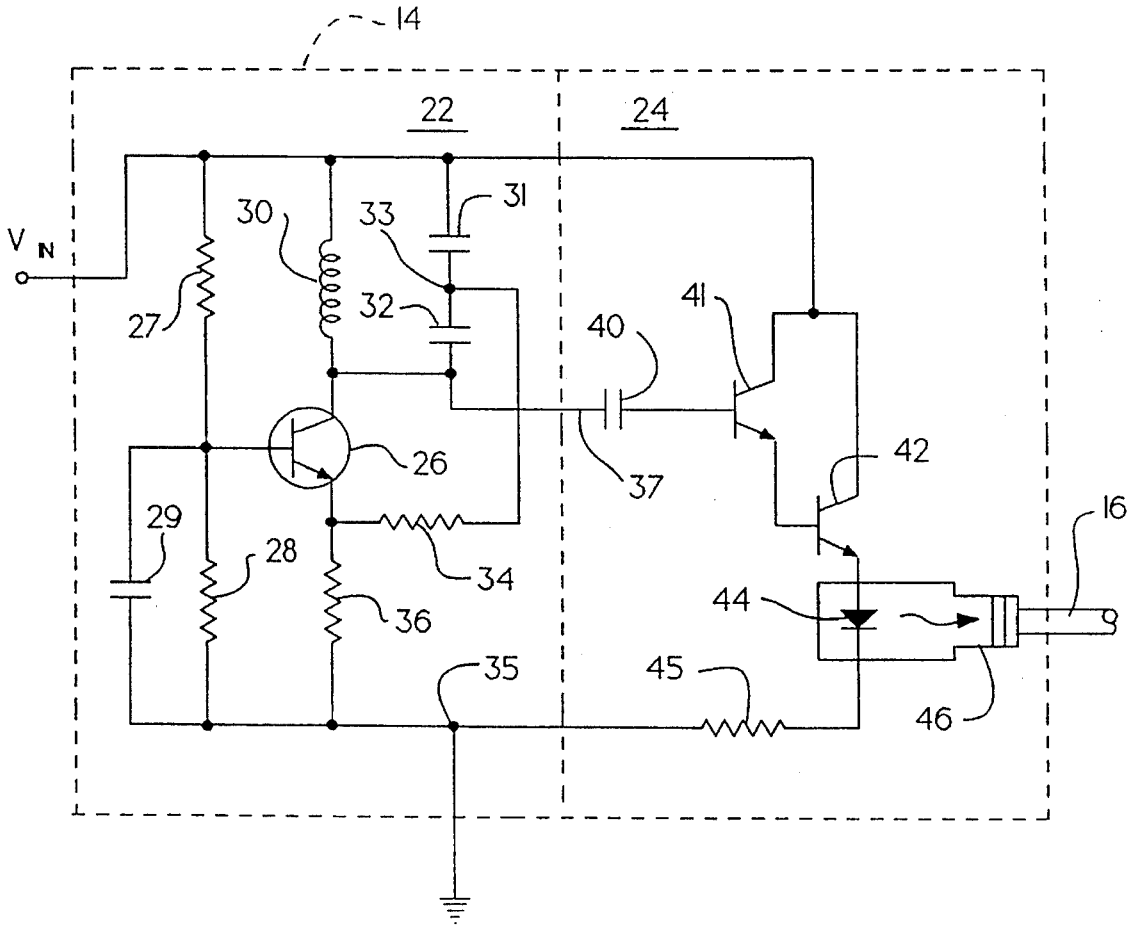
FIG. 2 is a schematic diagram of a presently preferred transmitter for use with the railway signal link of the invention.

As shown in FIG. 2, transmitter 14 preferably comprises an oscillator 22 electrically coupled to photo-emission means 24. In presently preferred embodiments, oscillator 22 is a Colpitts type of oscillator, although other oscillators may function adequately in this application. At the core of oscillator 22 is NPN transistor 26. The base of transistor 26 is biased using a voltage dividing network comprising resistors 27 and 28. A capacitor 29 is provided to further stabilize bias voltage. The periodic frequency of oscillator 22 is preselected by choice of component values within a tank circuit having an inductor 30 and capacitors 31 and 32. The nodal junction 33 between capacitors 31 and 32 is connected through resistor 34 to the emitter of transistor 26. This provides a path for regenerative feedback to sustain oscillation. The emitter of transistor 26 is also connected to ground terminal 35 through bias resistor 36.

The periodic electrical output of oscillator 22 is fed via output line 37 to coupling capacitor 40. Capacitor 40 serves to block any DC component in the signal on line 37 so that an AC signal is applied to the base of transistor 41. The emitter of transistor 41 is connected to the base of transistor 42, thus forming a common-emitter Darlington transistor network. The emitter of transistor 42 is connected to the serial combination of an infrared light emitting diode ("IR- LED") 44 and current limiting resistor 45. The common-emitter Darlington transistor network thus serves as a buffer amplifier between the higher output impedance of oscillator 22 and the lower input impedance of IR-LED 44. When the positive half-wave voltage at the emitter of transistor 42 rises to a sufficient bias level, IR-LED 44 conducts and generates a pulse of light energy. A light signal modulated at the preselected frequency is thus produced on optical fiber 16, which is attached by optical fiber connector 46.

Figure 3:
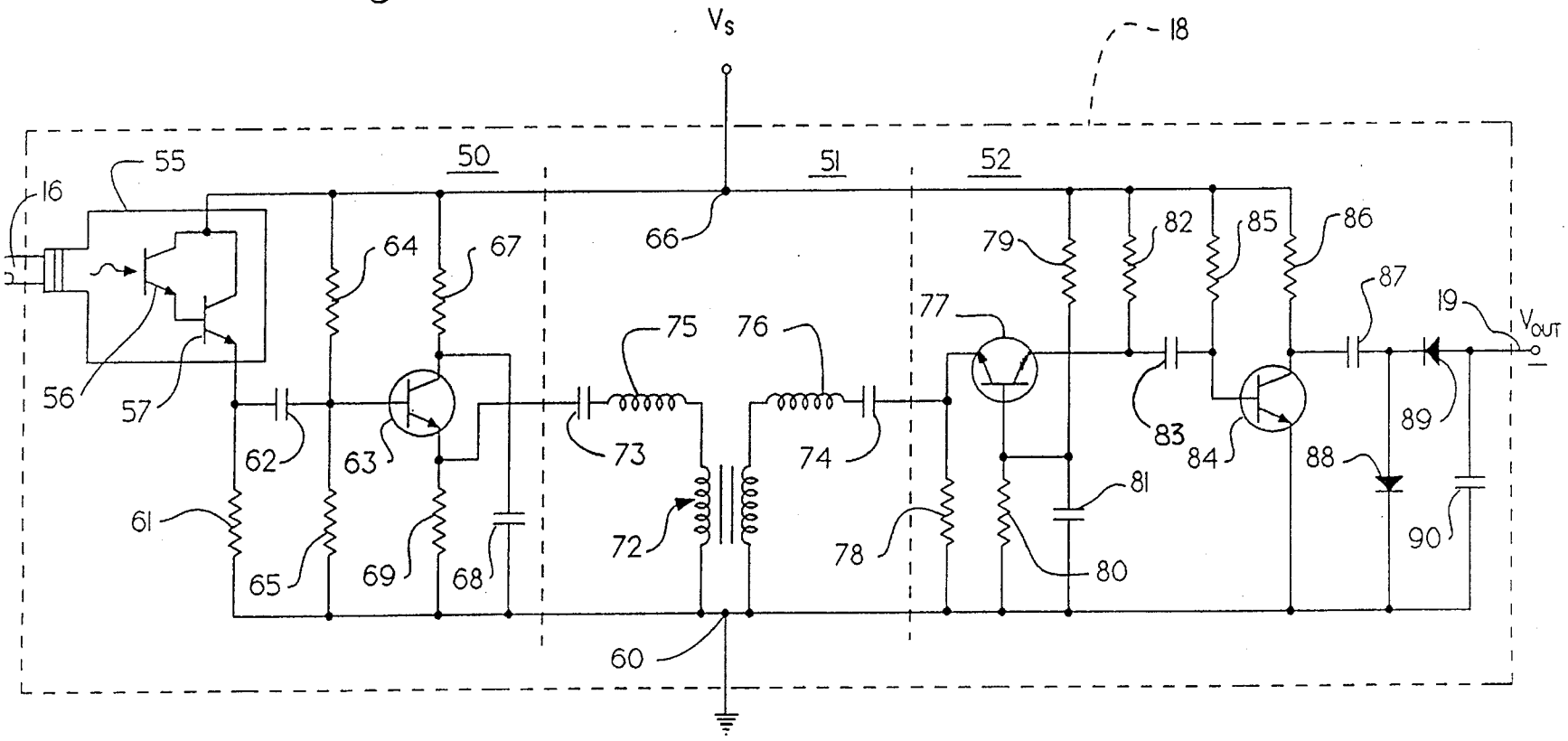
FIG. 3 is a schematic diagram of a presently preferred receiver for use with the railway signal link of the invention.

Referring to FIG. 3, receiver 18 generally comprises an input section 50, a discriminator section 51, and an output section 52. Generally, input section 50 receives the light signal from optical fiber 16 (which is connected via optical fiber connector 55) and produces an analogous electrical signal periodic at the preselected frequency. This is accomplished by first applying the periodic light signal to the base of photo-sensitive transistor 56. The emitter of transistor 56 is connected to the base of transistor 57, thus forming a photo-Darlington transistor network. The emitter of transistor 57 is connected to ground terminal 60 through resistor 61. To provide impedance matching between the photo-Darlington transistor network and discriminator section 51, an interposing emitter-follower transistor network is provided. Specifically, the emitter of transistor 57 is capacitively coupled through capacitor 62 to the base of NPN transistor 63. The base of transistor 63 is biased by a voltage dividing network comprising resistors 64 and 65. The collector of transistor 63 is connected to supply terminal 66 through resistor 67. A shunting capacitor 68, also connected to the collector of transistor 63, essentially shorts any undesirable harmonics appearing at this point. The emitter of transistor 63, connected to ground terminal 60 through resistor 69, forms the output terminal for input section 50.

Discriminator section 51 comprises circuitry producing a filtered electrical signal upon receiving a periodic electrical signal at the preselected frequency. Otherwise, section 51 produces essentially no signal at its output. In presently preferred embodiments, section 51 comprises a narrow bandpass filter having a pair of resonant circuits respectively tuned to the preselected frequency and electromagnetically coupled but galvanically isolated using transformer 72. The resonant circuits are series LC circuits, respectively having capacitors 73 and 74 and inductors 75 and 76. This configuration insures, for example, that ambient light which may be transmitted to receiver 18 if optical fiber 16 should break or become disconnected will not give an errant output.

Further vital enhancement may be provided by generally deriving the preferred inductance value $L_T$ of the transformer windings according to the following relationship: $L_T=L_c/Q$, where $L_c$ is the inductance and Q is the "quality factor" of the respectively connected of inductors 75 or 76. The quality factor is derived from the following equations:

(1) For a tuned circuit:

$$Q=f/B,$$

where:

f is the tuned frequency, and

B is the desired bandwidth (2) For a coil:

$$Q=2\pi fL_c/R_c,$$

where:

$R_c$ is the coil resistance

As shown, the quality factor is a function of frequency, desired bandwidth, inductance and coil resistance. Thus, it becomes an application specific variable. However, the quality factor of the resonant circuits should generally be kept as high as practically possible. According to the equation for $L_T$ above, this will force the inductance and hence the quality factor of the transformer windings to be relatively low with respect to the associated resonant circuit. As such, relatively small changes in transformer parameters will "break" the link between the input and output of section 51. This is a desirable result in a vital implementation.

For example, in an experimental prototype of this embodiment, a preselected frequency of 1000 Hertz was chosen. Inductors 75 and 76 were realized by practical inductors having a coil resistance of approximately 13 Ohms and inductance of approximately 86.9 MilliHenries(mH). As a result, a relatively high quality factor of approximately forty-two (42) was attained for the resonant circuits. Based on the equation for $L_T$, transformer 72 was implemented having winding inductances of approximately 2.1 mH.

Referring again to FIG. 3, the filtered output of section 51 is then fed to output section 52. For impedance matching purposes, this signal is first passed to a common base transistor amplifier including NPN transistor 77. The emitter of transistor 77 is connected through bias resistor 78 "which is used for input impedance stabilization" to ground terminal 60. The base of transistor 77 is biased using a voltage divider network comprising resistors 79 and 80. Capacitor 81 should have a value which essentially shunts resistor 80 at the preselected frequency. The collector of transistor 77 is connected to supply terminal 66 through resistor 82. The collector of transistor 77 is further coupled through capacitor 83 to the base of NPN transistor 84, which is biased by resistor 85. Transistor 84 is here arranged as a common-emitter amplifier. Thus, the emitter is connected directly to ground terminal 60. A sufficient input voltage appearing at the base of transistor 84 will cause a signal at the collector of transistor 84. Resistor 86 serves as a collector bias and load to transistor 84.

The output voltage appearing at the collector of transistor 84 is then passed to a voltage doubling rectifier network to produce DC output voltage $V_{OUT}$ at the link electrical output 19. Specifically, a coupling capacitor 87 blocks any DC component in the output voltage of transistor 84. The resulting AC signal is applied to the voltage doubling network which includes diodes 88 and 89 and capacitor 90 to produce voltage $V_{OUT}$. This is a classical voltage doubling network known in the art. It should be noted that because of the circuit arrangement in the embodiment illustrated, the polarity of $V_{OUT}$ is opposite that of $V_{IN}$. This enhances the vitality of the link since the expected polarity of a signal at link electrical output 19 is also opposite of $V_s$.

Figure 4:
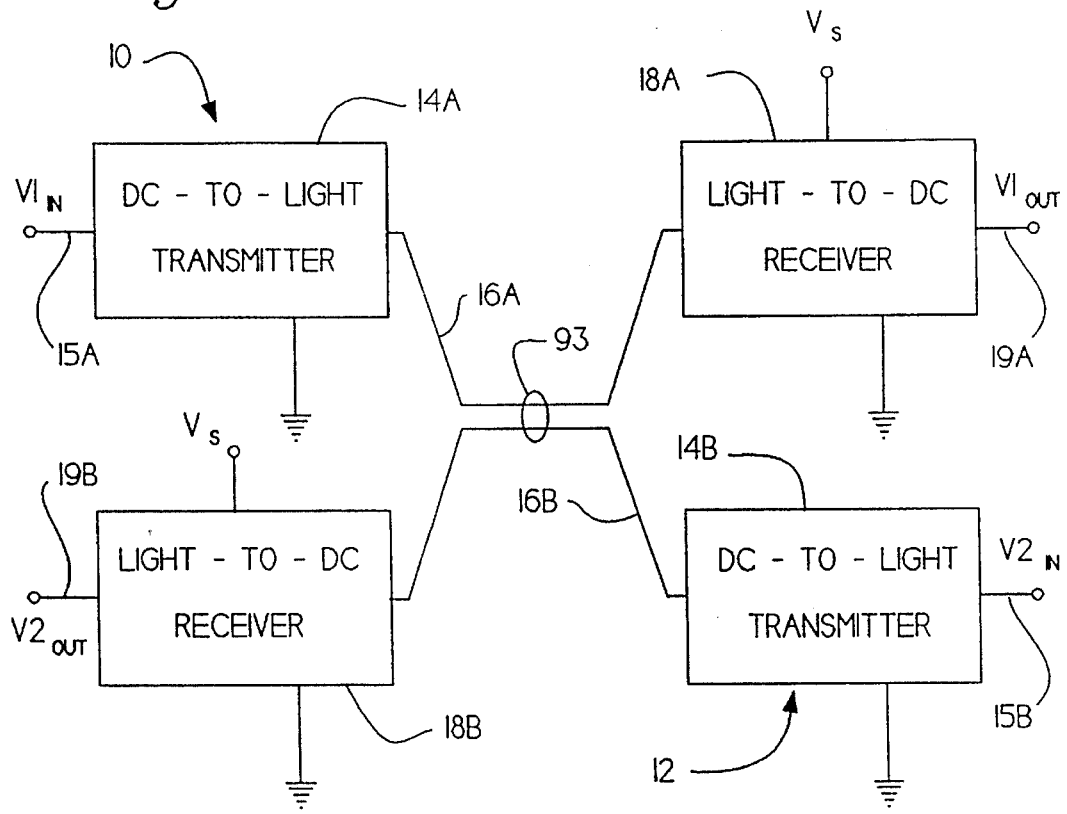
FIG. 4 is a diagrammatic representation of a bidirectional railway signal link of the invention.

FIG. 4 illustrates a bidirectional embodiment of the railway signal link of the invention. This configuration uses a transmitter and receiver pair at each of locations 10 and 12 to communicate signal information in both directions. Specifically, a transmitter 14A at location 10 receives DC input signal $V1_{IN}$ at input 15A. Signal $V1_{IN}$ is converted to a periodic light signal and is conducted over optical fiber 16A to receiver 18A. Receiver 18A converts the light signal to DC output signal $V1_{OUT}$ on output 19A. In addition, a DC input signal $V2_{IN}$ may be received on input 15B at location 12. Transmitter 14B converts signal $V2_{IN}$ to a periodic light signal which is conducted over optical fiber 16B to location 10. Receiver 18B receives the light signal from optical fiber 16B and responsively produces signal $V2_{OUT}$ on link output 19B. In this embodiment, each directional transmitter-receiver pair may be tuned to operate at different preselected frequencies. Also, optical fibers 18A and 18B may be constructed as a single, two fiber cable 93 or as part of a larger bundle of fiber optic cable.

Figure 5:
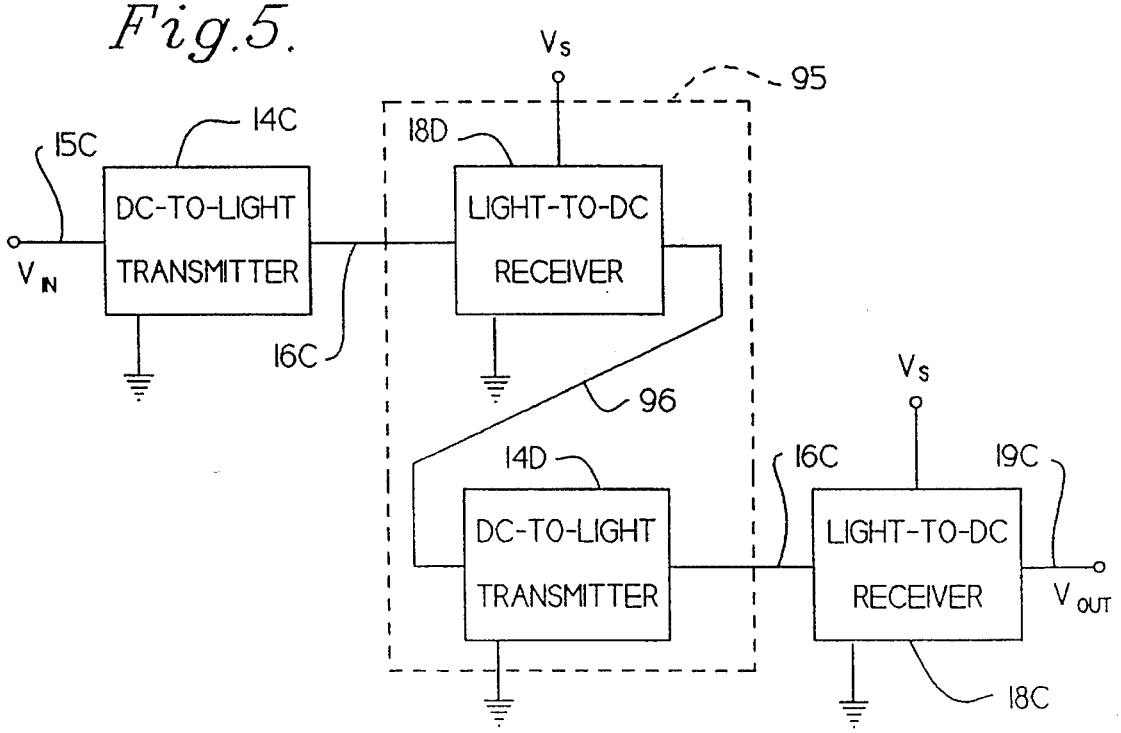
FIG. 5 is a diagrammatic representation of a railway signal link of the invention utilizing an interposing repeater to extend operable length.

Although optical fiber has excellent photonic conductivity characteristics, line losses can limit effective length. Thus, as shown in FIG. 5, the railway signal link may be equipped to increase operable length to virtually any desired value. Similar to other embodiments, DC input signal $V_{IN}$ is received at link electrical input 15C by transmitter 14C. Transmitter 14C converts the electrical signal to a periodic light signal which is applied to optical fiber 16C. Receiver 18C produces DC output voltage $V_{OUT}$ at link electrical output 19C. To compensate accrued losses, one or more interposing repeaters 95 are positioned at points along optical fiber 16C. Repeater unit 95 comprises a repeater receiver 18D constructed as shown in FIG. 3. Receiver 18D receives the light signal from a section of optical fiber 16C and produces a DC repeater signal on electrical conductor line 96. The DC repeater signal is applied to the input of a transmitter 14D constructed as shown in FIG. 2. Transmitter 14D then outputs a compensated light signal on a second section of optical fiber 16C.

It can thus be seen that a railway signal link for transmitting information from a link electrical input at a first terminal location to a link electrical output at a second terminal location has been provided. The link is constructed utilizing vital design principles so that a failure of any component will generally reduce the DC output signal to an unusable level. Discriminator means are provided to protect against producing an output signal due to ambient light or other unwanted input.

Certain preferred embodiments have been described and shown herein. While the invention is intended primarily to be used in railway signalling, it may be useful in other environments. Thus, it is to be understood that various other embodiments and modifications can be made within the scope of the following claims.

We claim:

1. A vital railway signal link for transmitting information from a link electrical input at a first terminal location to a link electrical output at a second terminal location, said link comprising:

a transmitter at said first terminal location including an oscillator operable upon application of a DC input signal at said link electrical input to produce a periodic electrical signal of a preselected frequency;

said transmitter further having photo-emission means responsive to said periodic electrical signal for emitting a light signal modulated at said preselected frequency;

an optical conductor receiving said light signal from said transmitter and extending to said second terminal location;

a receiver at said second terminal location including a photo-sensitive input means for receiving said light signal from said optical conductor and producing an analogous electrical signal periodic at said preselected frequency;

said receiver farther having a bandpass filter electrically connected to said photo-sensitive input means to receive said analogous electrical signal, said bandpass filter tuned to produce a filtered electrical signal upon application of an electrical signal at said preselected frequency and otherwise producing essentially no electrical signal; and said receiver further having output means electrically connected to receive said filtered electrical signal for producing a DC output signal at said electrical output.

2. The vital railway signal link of claim 1 wherein said bandpass filter comprises at least one series LC resonant circuit.

3. The vital railway signal link of claim 1 wherein said bandpass filter comprises a first resonant circuit coupled to a second resonant circuit by an interposing electrical isolation coupler.

4. The vital railway signal link of claim 3 wherein said interposing electrical isolation coupler comprises a transformer having a primary winding electromagnetically coupled to a secondary winding.

5. The vital railway signal link of claim 4 wherein said first and second resonant circuits each comprise, in series, a capacitor and an inductor thereby forming a series LC circuit.

6. The vital railway signal link of claim 5 wherein said primary winding and said secondary winding each have an inductance value generally equal to a ratio of an inductance divided by a quality factor of respective inductors of said first and second resonant circuits.

7. The vital railway signal link of claim 1 wherein said oscillator includes a Colpitts oscillator.

8. The vital railway signal link of claim 1 wherein said photo-emission means comprises a Darlington emitter follower transistor network electrically connected to an infrared light emitting diode.

9. The vital railway signal link of claim 1 wherein said photo-sensitive input means comprises a photo-Darlington transistor network electrically connected to an emitter-follower transistor network.

10. The vital railway signal link of claim 1 wherein said output means comprises the combination of:

a common-base transistor network electrically connected to an output of said bandpass filter;

a common-emitter switching amplifier electrically connected to an output of said common-base transistor network; and a rectifier network electrically connected to an output of said switching amplifier, an output of said rectifier network forming said electrical link output.

11. A bidirectional vital railway signal link for transmitting information between a first terminal location and a second terminal location, said link comprising:

a first terminal location transmitter operable to receive a first DC input signal at a first link electrical input and produce a first light signal modulated at a first preselected frequency;

a second terminal location transmitter operable to receive a second DC input signal at a second link electrical input and produce a second light signal modulated at a second preselected frequency;

a first fiber optic conductor receiving said first light signal from said first terminal location transmitter and extending to said second terminal location;

a second fiber optic conductor receiving said second light signal from said second terminal location transmitter and extending to said first terminal location;

a second terminal location receiver operable to receive said first light signal from said first fiber optic conductor and produce a first DC output signal at a first link electrical output;

said second terminal location receiver having first discriminator means for giving essentially no signal at said first link electrical output upon receipt of other than a light signal modulated at said first preselected frequency;

a first terminal location receiver operable to receive said second light signal from said second fiber optic conductor and produce a second DC output signal at a second link electrical output; and said first terminal location receiver having second discriminator means for giving essentially no signal at said second link electrical output upon receipt of other than a light signal modulated at said second preselected frequency.

12. The bidirectional vital railway signal link of claim 11 wherein said first and second discriminator means each comprise a bandpass filter respectively tuned to said first and second preselected frequencies.

13. The bidirectional vital railway signal link of claim 11 wherein said first and second discriminator means each comprise a bandpass filter having a first resonant circuit electromagnetically coupled to a second resonant circuit, said first and second resonant circuits of each bandpass filter both tuned to respective of said preselected frequencies.

14. The bidirectional vital railway signal link of claim 13 wherein said first and second discriminator means each comprise a transformer having a primary winding and a secondary winding to electromagnetically couple respective of said first resonant circuit and said second resonant circuit, said primary winding and said secondary winding each having an inductance value generally equal to a ratio of an inductance divided by a quality factor of respective inductors of said first and second resonant circuits.

15. The bidirectional vital railway signal link of claim 11 wherein said first fiber optic conductor and said second fiber optic conductor collectively comprise a two-fiber optical conductor cable.

16. The bidirectional vital railway signal link of claim 11 further comprising at least one repeater interposed between said first fiber optic conductor and said second fiber optic conductor to compensate losses in said first and second light signals to increase the operable range of said link.

17. The bidirectional vital railway signal link of claim 16 wherein said at least one repeater comprises a repeater receiver unit operable to receive a light signal from a first section of an associated fiber optic conductor and produce a DC repeater signal, said at least one repeater further comprising a repeater transmitter receiving said DC repeater signals and producing a compensated light signal respectively applied to a second section of said first and second fiber optic conductors.

18. A vital railway signal link for transmitting information from a link electrical terminal input at a first terminal location to a link electrical output at a second terminal location, said link comprising:

transmitting means at said first terminal location for receiving a DC signal at said link electrical input and emitting in response thereto a light signal modulated at a preselected frequency;

a fiber optic conductor receiving said light signal from said transmitting means and extending to said second terminal location; and a receiver at said second location responsive to said light signal to produce a DC output signal at said link electrical output, said receiver having a discriminator circuit including an electrical isolation coupler giving essentially no output signal at said link electrical output upon receipt of other than a light signal modulated at said preselected frequency.

19. The vital railway signal link of claim 18 further comprising at least one repeater interposing said fiber optic conductor, said repeater operable to compensate accrued losses in said light signal to increase the operable range of said link.

20. The vital railway signal link of claim 19 wherein said repeater comprises a repeater receiver operable to receive a light signal from a first section of said fiber optic conductor and produce a DC repeater signal, said repeater further comprising a repeater transmitter receiving said DC repeater signal and producing a compensated light signal applied to a second section of said fiber optic conductor.

21. The vital railway signal link of claim 18 wherein said discriminator circuit comprises a first resonant circuit coupled to a second resonant circuit by said electrical isolation coupler, said first and second resonant circuits each tuned to said preselected frequency.

22. The vital railway signal link of claim 21 wherein said electrical isolation coupler comprises a transformer providing electromagnetic coupling.

23. The vital railway signal link of claim 21 wherein said first and second resonant circuits each comprise a series LC circuit.

24. A method of transmitting railway signal information from a first location to a second location comprising the steps of:

(a) detecting at said first location a DC input signal;

(b) producing in response to said DC input signal a periodic electrical signal of a preselected frequency;

(c) emitting in response to said periodic electrical signal a light signal modulated at said preselected frequency;

(d) applying said light signal to an optical conductor extending from said first location to said second location;

(e) detecting said light signal at said second location and producing in response thereto an analogous electrical signal;

(f) applying said analogous electrical signal to a vital bandpass filter circuit tuned to said preselected frequency; and (g) rectifying an output of said vital bandpass filter to produce a DC output signal at said second location.

25. The method of claim 24 further comprising between steps (d) and (e) the following step:

h) amplifying said light signal at at least one interposing location along said optical conductor in order to compensate accrued losses.

* * * * *